US010036202B2

(12) United States Patent
Bornack

(10) Patent No.: US 10,036,202 B2
(45) Date of Patent: Jul. 31, 2018

(54) SECURING DEVICE

(71) Applicant: Bornack GmbH & Co. KG, Ilsfeld (DE)

(72) Inventor: Klaus Bornack, Mundelsheim (DE)

(73) Assignee: Bornack GmbH & Co. KG, Ilsfeld (DE)

( * ) Notice: Subject to any disclaimer, the term of this patent is extended or adjusted under 35 U.S.C. 154(b) by 332 days.

(21) Appl. No.: 14/398,104

(22) PCT Filed: Apr. 30, 2013

(86) PCT No.: PCT/EP2013/059053
§ 371 (c)(1),
(2) Date: Jan. 15, 2015

(87) PCT Pub. No.: WO2013/164366
PCT Pub. Date: Nov. 7, 2013

(65) Prior Publication Data

US 2015/0114752 A1 Apr. 30, 2015

(30) Foreign Application Priority Data

Apr. 30, 2012 (DE) ..... 10 2012 207 223

(51) Int. Cl.

| | |
|---|---|
| ***E06C 7/18*** | (2006.01) |
| ***A62B 35/00*** | (2006.01) |
| ***A62B 1/14*** | (2006.01) |
| ***A62B 35/04*** | (2006.01) |

(52) U.S. Cl.
CPC ..... *E06C 7/186* (2013.01); *A62B 1/14* (2013.01); *A62B 35/0081* (2013.01); *A62B 35/04* (2013.01)

(58) Field of Classification Search
CPC ..... A62B 1/14; A62B 35/0037; A62B 35/04; A62B 35/0081; A62B 35/005; E06C 7/186; E06C 7/187; A63B 29/02
USPC ..... 182/193; 188/65.1, 65.2, 65.5
See application file for complete search history.

(56) References Cited

U.S. PATENT DOCUMENTS 4,034,828 A * 7/1977 Rose ..... A62B 1/14 182/5
4,059,871 A * 11/1977 Swager ..... A62B 1/14 182/5
4,077,094 A * 3/1978 Swager ..... A62B 1/14 182/5

(Continued)

FOREIGN PATENT DOCUMENTS

DE 35 10 602 A1 9/1986
DE 695 17 850 T2 12/2000

(Continued)

*Primary Examiner* — Daniel P Cahn
(74) *Attorney, Agent, or Firm* — Robert A. Blaha; Smith Tempel Blaha LLC

(57) ABSTRACT

A fall arrest device for securing a climber to a cable in a manner that prevents the climber from falling. The device can run along an elongate securing cable as the climber ascends and descends during use. The device has a base body having a guide element and a receiving body having longitudinal axis designed to receive the cable therebetween, a housing fastened movably on the base body, and a securing element having a first securing bolt. The securing element is fastened rotatably on the base body and the housing in order to clamp the cable against the receiving body to arrest the climber during a fall.

18 Claims, 6 Drawing Sheets

(56) References Cited

U.S. PATENT DOCUMENTS 4,193,475 A * 3/1980 Sweet ..... A62B 35/0062 182/8
4,542,884 A * 9/1985 Dodge, Jr. ..... A62B 1/14 182/5
4,657,110 A * 4/1987 Wolner ..... A62B 35/04 182/192
4,923,037 A * 5/1990 Stephenson ..... A62B 35/04 188/188
5,156,240 A * 10/1992 Ostrobrod ..... A62B 1/14 182/193
5,265,696 A * 11/1993 Casebolt ..... A62B 1/14 182/192
5,323,873 A * 6/1994 Pelofi ..... A62B 35/04 182/192
5,400,869 A * 3/1995 Rocourt ..... A62B 1/14 182/133
5,638,919 A * 6/1997 Pejout ..... A62B 1/14 182/192
5,855,251 A * 1/1999 Deuer ..... A62B 1/14 182/192
5,860,493 A * 1/1999 Cherpitel ..... A62B 1/14 182/193
5,924,522 A * 7/1999 Ostrobrod ..... A62B 1/14 182/191
5,934,408 A * 8/1999 Flux ..... A62B 1/14 182/192
6,019,195 A * 2/2000 Pelofi ..... A62B 1/14 182/192
6,029,777 A * 2/2000 Rogelja ..... A62B 1/14 182/192
6,056,086 A * 5/2000 Gortan ..... A62B 35/04 182/197
8,376,081 B2 * 2/2013 Schwarzenbach ..... A62B 1/14 182/193
8,464,832 B1 * 6/2013 Rullo ..... A62B 35/0037 182/192
2002/0014370 A1 * 2/2002 Casebolt ..... A62B 1/14 182/5
2003/0051944 A1 * 3/2003 Shea ..... A62B 1/14 182/193
2004/0129494 A1 * 7/2004 Cherpitel ..... A62B 1/14 182/5
2006/0070809 A1 * 4/2006 Barzilai ..... E06B 7/28 182/193
2006/0283662 A1 * 12/2006 Martin ..... A62B 1/14 182/8
2006/0289235 A1 * 12/2006 Chen ..... A62B 1/14 182/192
2007/0215411 A1 * 9/2007 Petzl ..... A62B 1/14 182/193
2009/0057631 A1 * 3/2009 Rinklake ..... A62B 1/10 254/277
2010/0200333 A1 * 8/2010 Maurice ..... A62B 1/14 182/133
2012/0005863 A1 * 1/2012 Chen ..... A62B 1/14 24/132 R
2012/0193166 A1 * 8/2012 Rogelja ..... A62B 1/14 182/5
2014/0020983 A1 * 1/2014 Casebolt ..... A62B 1/14 182/241
2014/0020988 A1 * 1/2014 Casebolt ..... A62B 35/0081 188/65.1
2014/0262622 A1 * 9/2014 Thompson ..... A62B 1/14 182/241

FOREIGN PATENT DOCUMENTS

EP 0 678 310 A1 10/1995
EP 0 861 678 A2 9/1998

* cited by examiner

SECURING DEVICE

TECHNICAL FIELD

The present invention relates to a securing device which is adapted for running along an elongate securing means on a person to be secured. The present invention relates to a method for securing a person with a securing device which is adapted for running along an elongate securing means on a person to be secured.

BACKGROUND OF THE INVENTION

For cleaning and maintenance work on higher buildings, climbing aids, in particular ladders, are frequently provided with a securing rail or a securing cable, whereon a fall arrester is guided displaceably or in a co-running manner. The fall arrester can be connected to a harness worn by the person to be secured so that this person is secured against falling. When ascending or descending on the ladder, the fall arrester virtually necessarily follows the person to be secured. The harness worn by the person to be secured is either directly or indirectly connected via a safety lanyard to a brake actuating member for actuating a brake or a locking apparatus of the fall arrester. If the brake actuating member is subjected to a larger force in the downward direction, which is the case for example when the person to be secured falls, the fall arrester is necessarily locked on the rail or clamps the safety lanyard.

DESCRIPTION OF THE INVENTION

There may be a need to provide a robust and simple-to-operate cable securing device for securing a climber on a securing means.

According to a first aspect of the present invention, a securing device is described which is adapted for running along an elongate securing means on a person to be secured. The securing device comprises a base body having a guide element, a receiving body, which has a longitudinal axis, a housing, which is fastened movably on the base body and a securing element having a first securing bolt.

The receiving body is disposed on the base body in such a manner that the securing means is guidable, e.g. in a groove of the receiving body, between the receiving body and the guide element. The securing element is fastened rotatably about a first axis of rotation on the base body. The first securing bolt is coupled to the housing in such a manner that during a movement of the housing relative to the base body the securing element is rotatable about the first axis of rotation so that as a result of a first rotation one end of the securing element is movable in the direction of the receiving body (e.g. in the direction of the groove) so that the securing means is clampable between the receiving body and the securing element.

According to a further aspect of the present invention, a method for securing a person with the securing device described above is described, which is adapted for running along an elongate securing means on a person to be secured. According to the method, the securing means is guided between the receiving body and the guide element, for example, if the person to be secured or the climber climbs with the securing device along the securing means.

A cable, a belt or a retaining rod can be described as securing means within the framework of the present application. The person to be secured is fastened to the securing means by the securing device, where by the securing device the person to be secured can move along the securing means or can climb along said means.

The base body, for example, has a plate-shaped geometry. The base body is designed to be solid and stable or undeformable. The climber can be coupled directly or indirectly to the base body. The base body is configured to be solid in such a manner that, for example, more than the body weight of the climber can be received in the base body without resulting in deformations of the base body. The climber can be fastened to the base body, for example, by a retaining cable or by a brake cable.

The base body further comprises, for example, a first (e.g. plate-shaped) base element and a second (e.g. plate-shaped) base element. The first base element and the second base element are formed at a distance from one another and rigidly connected to one another by connecting elements so that a cavity is formed between the first base element and the second base element. The bolts or pivot pins described in the following can be fastened in the first base element and the second base element and run through the cavity. A more stable mounting of the bolts or pivot pins is thus created since these are each fastened to the base body at two fastening points.

Furthermore, the base body has the guide element. If the securing means is inserted between the receiving body and the guide element, the securing element rests on the guide element and can slide along the guide element or move relative to the guide element. The guide element can, for example, be configured as a cable guide roller. Furthermore the guide element can have a coated surface so that small frictional forces are produced between the securing means and the guide element.

The receiving body can, for example, comprise a cylindrical or rod-shaped body shape or a piston shape. The receiving body has a longitudinal axis which, for example, forms an axis of symmetry of the receiving body.

The receiving body can comprise a groove which is configured in such a manner that the securing means can be inserted at least partially into the groove. The groove in particular has a rectilinear, non-curved profile. The groove extends along a direction which runs, for example, parallel to the direction of the longitudinal axis. The securing means is, for example, inserted between the guide element and the groove of the receiving body so that the securing device can be displaced relative to the securing means. The receiving body can comprise a first and a second receiving element. The first and the second receiving element each have a first and a second part of the groove.

The securing element is, for example, a securing lever which is fastened rotatably about the first axis of rotation on the base body. The first securing bolt is fastened on the securing element. The securing bolt is in particular disposed at a distance from the first axis of rotation on the securing element or disposed eccentrically. If a force is exerted on the securing bolt which does not run completely along a line between the bolt and the first axis of rotation, this results in a rotation of the securing element about the first axis of rotation. In particular, a force which has a component in the tangential direction of direction of movement of the securing bolt in the circumferential direction about the axis of rotation, results in a rotation of the securing element.

The securing element (e.g. the securing lever) for example has a first end. Through rotation of the securing element the first end is pivoted in the direction of the receiving body or that of the groove until a clamping is produced between the securing element and the receiving body. This clamping leads to a high friction between the securing means and the receiving body so that a relative movement of the securing device along the securing means is restricted. If the force acting on the securing bolt is increased, the clamping is strengthened in such a manner that a relative movement between the securing device and the securing means is prevented.

For exerting this force on the first securing bolt, this is coupled to the housing. During a movement of the housing relative to the base body (on which base body the securing element is rotatably fastened), the first securing bolt is moved according to the movement of the housing relative to the base body so that a rotation of the securing element about the first axis of rotation is brought about. This rotation of the securing element which is initiated by the movement of the housing enables a clamping or a release of the securing means between the receiving body and the securing element.

The housing thus forms an actuating device. The person to be secured can grip the housing and move accordingly in order to thus bring about the rotation of the securing element and produce a specific clamping of the securing means on the securing device. The housing can for example at least partially surround the base body and the securing element. The housing is coupled to the base body in such a manner that the housing can move relative to the base body along a translational direction of motion and/or a rotational direction of motion. Exemplary embodiments depicted in the following show an exemplary coupling of the housing to the base body in order to enable a translational and/or rotational movement of the housing relative to the base body.

Furthermore, by flexible application of force on the housing, the person to be secured can specifically control the clamping action or braking action between the securing device and the securing means.

An effective securing device is thus provided with the present invention in which the person to be secured can flexibly control the clamping action or the braking action. The securing device according to the invention has only a few components for implementing the braking or clamping effect so that the risk of defects or the probability of failure of the securing device is thereby reduced and a robust securing device can be provided.

According to a further exemplary embodiment, the securing device comprises a pivot pin. The housing is fastened rotatably about a second axis of rotation by the pivot pin on the base body. The first securing bolt of the securing element is coupled to the housing in such a manner that during a rotation of the housing about the second axis of rotation the rotation of the securing element about the first axis of rotation is generatable relative to the base body.

With the exemplary embodiment described, a rotation of the housing about the second axis of rotation has the result that the first securing bolt is moved and thus the rotation of the securing element about the first axis of rotation is initiated. To this end in particular the coupling position of the first securing bolt with the housing is spaced apart from the coupling position of the pivot pin with the housing.

According to a further exemplary embodiment, the housing has a first guide groove. The pivot pin is coupled to the first guide groove in such a manner that the housing is fastened displaceably relative to the base body. The first guide groove can, for example, be formed by an oblong hole in the housing. The pivot pin can move along the first guide groove according to the relative movement between the housing and the base body.

According to a further exemplary embodiment, the first guide groove is configured in such a manner that during a displacement, i.e. during a translational movement, of the housing relative to the base body the first securing bolt is movable by the displacement of the housing in such a manner that the securing element is rotatable about the first axis of rotation.

The first guide groove can in particular have a rectilinear profile. If the housing is thus moved with the translational movement relative to the base body, the pivot pin is displaced along the guide groove. The first securing bolt is coupled to the housing in such a manner that as a result of the translational movement of the housing, a rotational movement of the securing element is produced. The translational movement of the housing leads to an application of force onto the first securing bolt, which force has a component in the direction of the circumferential direction about the first axis of rotation of the securing element so that a rotation of the securing element is brought about.

In particular in the event of a fall of the person to be secured or in a panic situation, the person to be secured can simply rest on the housing in order to bring about a rotation of the securing element. Furthermore, the person to be secured can simply exert a pressure with his body or his hand on the housing in order to bring about a (translational or rotational) movement of the housing and in order to thus bring about a rotation of the securing element.

According to a further exemplary embodiment, the housing has a second guide groove in which the first securing bolt is guided. The first securing bolt is coupled displaceably in the second guide groove. Thus, a smoother-running mechanism can be provided, in particular if the housing undergoes a relative displacement relative to the base body and as a result the securing element rotates about the first axis of rotation. During the rotation of the securing element, the first securing bolt can be displaced along the second guide groove in order to avoid any clamping in the movement sequence between the housing, the base body and the securing element. By the second guide groove, for example, a link guidance is provided by which a translational movement of the housing is converted into a rotational movement of the securing element.

According to a further exemplary embodiment, the securing element has a second securing bolt. The housing for example has a further second guide groove, which is configured at an angle to the second guide groove. The further second guide groove is configured in such a manner, and the second securing bolt is coupled to the further second guide groove in such a manner, that during the movement of the housing relative to the base body the securing element is rotatable about the first axis of rotation.

The second securing bolt is in particular located at a distance from the first axis of rotation and the first securing bolt on the securing element. The introduction of a further securing bolt on the securing element leads to a more robust coupling between the securing element and the housing. Furthermore, by a specific arrangement of the first securing bolt and the second securing bolt on the securing element it can be ensured that, for example, during a rotational movement of the housing the force for displacement of the securing element is exerted on the first securing bolt and during a translational movement of the housing the force for rotation of the securing element is applied to the second securing bolt. Furthermore, as a result of the provision of a second securing bolt a redundant system can be provided so that in the event of a defect (e.g. breaking) of one of the securing bolts, a clamping of the securing device with the securing means is nevertheless made possible.

According to a further exemplary embodiment, the securing device comprises a spring element which is coupled to the base body and the housing. In an initial position of the base body relative to the housing, the securing element allows a movement of the securing means in the groove. The spring element is adapted in such a manner that by a spring force of the spring element the housing can be provided in the initial position of the base body relative to the housing.

In other words, the spring element is adapted in such a manner that the spring force urges the housing or securing element into the initial position. In other words, the spring force acts against the force which causes the securing element to rotate in order to produce a clamping between the securing means the securing device. In other words, the spring force increases the distance between receiving body and the first end of the securing element.

The spring force can, for example, comprise a spiral spring which is disposed on the pivot pin or a further pivot pin which rotatably mounts the securing element on the base body. Furthermore, the spring element can comprise a helical spring which is disposed between the base body on the one hand and the housing or the securing element on the other hand.

According to a further exemplary embodiment, the securing device further comprises a brake lever which is fastened rotatably on the base body. A coupling region for coupling on the person to be secured is formed at a first end of the brake lever and a clamping region is formed at a second end of the brake lever, which is formed opposite the first end. The brake lever is disposed rotatably on the base body in such a manner that the clamping region is movable in the direction of the receiving body in such a manner or the groove so that a clamping of the securing means can be produced between the receiving body and the brake lever. The brake lever is in particular fastened rotatably about a further axis of rotation on the base body, where the first end of the brake lever is formed relative to the further axis of rotation on an opposite end relative to the second end of the brake lever. Furthermore, the brake lever is in particular fastened rotatably on the base body in such a manner that in the event of a pull in a substantially vertical direction (e.g. in a direction parallel to the longitudinal axis) on the coupling region a rotation of the brake lever is initiated until the clamping region is moved so far in the direction of the receiving body that the securing means is clamped between the receiving body and the brake lever.

By the arrangement of the brake lever, a further securing mechanism is introduced so that in the event of a fall of the person to be secured, a vertical pull in the direction of the gravitational force automatically and independently, i.e. without action of the person to be secured accomplishes a clamping of the securing device and the securing means. A fall of the person to be secured is thus intercepted without this person actively operating the securing device or the brake lever.

According to a further exemplary embodiment, the receiving body has a groove, wherein the receiving body is disposed on the base body in such a manner that the securing means is guidable in the groove between the receiving body and the guide element.

According to a further exemplary embodiment, the groove has a V-shaped cross-section.

The groove with the V-shaped cross-section in particular has two opposite flanks which each extend from the surface of the receiving body in the direction of the longitudinal axis (central axis) of the receiving body along a cross-sectional plane of the cross-section of the receiving body. A spacing of the flanks is reduced along a profile (along a cross-sectional plane of the receiving body) from the surface of the receiving body in the direction of the longitudinal axis (e.g. central axis) of the receiving body. The flanks can come in contact at a shortest distance from one another in the receiving body (zero spacing) or be spaced apart (trapezoidal groove). The term "V-shaped" cross-section is hereinafter therefore understood as trapezoidal groove. The greatest spacing of the flanks is given in the region of the surface (circumference) of the receiving body so that the securing means can be inserted and when pressing in the securing means in the direction of the longitudinal axis of the receiving body, a clamping of the securing means is generated in the groove.

As a result of the V-shaped cross-section of the groove, the clamping force between the securing means and the securing device can be effectively generated. A securing means having a round cross-section such as, for example, a cable can be inserted in the wedge-shaped or V-shaped groove. As a result of the wedge-shaped cross-sectional shape of the groove, clamping forces at at least contact points on the flanks of the groove can be transferred to the securing element. A clamping between the securing element and the groove can thus be effectively enabled. In contrast to a flat contact surface between the receiving body and the securing means, a lower clamping force is required when inserting the securing means into the described groove in order to provide a clamping of the securing means on the receiving body. In other words a small force is required to press the cable element into the groove and thereby achieve a clamping.

According to a further exemplary embodiment, the guide element has a further groove having a further wedge-shaped (V-shaped) cross-section or having a round cross-section (U-shaped cross-section). The securing means can be guided in the further groove.

According to a further exemplary embodiment, the guide means in particular is a roller.

According to a further exemplary embodiment, the receiving means has a fluted or structured surface at least in the groove, i.e. at least on a contact surface of the securing means on the receiving body. As a result, a friction between receiving body and securing means can be increased.

According to a further exemplary embodiment, the receiving body is disposed rotatably about its longitudinal axis on the base body in such a manner that the receiving body is rotatable from a closed position into an open position. In the open position (e.g. in the groove) the securing means is insertable between the receiving body and the guide element and in the closed position a withdrawal of the securing means (e.g. from the groove) between the receiving body and the guide element can be prevented.

In other words, the receiving body is disposed rotatably about its longitudinal axis on the base body in such a manner that in the open position a distance between the receiving body and the guide element is greater than the diameter of the securing means so that this can be inserted and withdrawn.

In the closed position the receiving body and the guide element surround the securing means in such a manner that this cannot be withdrawn, for example, through a gap between the receiving body and the guide element. Thus, during operation the receiving body can be placed in the closed position so that an undesired removal of the securing device from the securing element is prevented. The safety of the securing device is thereby increased.

In a further exemplary embodiment, the base body comprises a coupling element. The coupling element couples the receiving body to the base body in such a manner that the receiving body is fastened rotatably between the open position and the closed position on the base body.

The coupling element can, for example, at least partially surround the receiving body. For example, the coupling element can comprise a type of socket in which the receiving body is fastened rotatably. In particular the coupling element can fasten the receiving body in such a manner that the receiving body is movable relative to the coupling element translationally along the longitudinal axis and at the same time is movable rotationally about the longitudinal axis.

According to a further exemplary embodiment, a coupling groove is formed in the coupling element. The receiving body has a coupling bolt which is coupled in the coupling groove. The coupling groove in the coupling element of the receiving body is formed in such a manner that the coupling bolt is guided along the coupling groove during rotation of the receiving body about the longitudinal axis.

With the exemplary embodiment described, the person to be secured can, for example, rotate the receiving body about the longitudinal axis in order to change between the open position and the closed position. At the same time, the coupling groove predefines the rotational movement so that an unintentional slipping of the receiving body out from the coupling element is prevented.

According to a further exemplary embodiment, the coupling groove further has a helical course about the longitudinal axis so that during application of a force on the receiving body along the longitudinal axis the receiving body is movable in the longitudinal direction and at the same time the receiving body is rotatable about the longitudinal axis.

The helical profile of the coupling groove describes a profile which one component has in the circumferential direction about the longitudinal axis and one component has parallel to the longitudinal axis. The person to be secured can thus exert a force on the receiving body along a translational movement so that the receiving body moves with a translational movement along the longitudinal axis. At the same time the helical profile of the coupling groove induces a rotational movement of the receiving body about the axis of rotation. Thus, a rotation of the receiving body about the longitudinal axis can be produced by exerting a translational force on the receiving body. This has the result that for changing between the open position into the closed position a simple operation is made possible, namely whereby the person to be secured simply, for example, applies a compressive force to the receiving body. It is therefore not necessary to manually exert a more complex rotating movement of the receiving body.

According to a further exemplary embodiment, the securing device has a further spring element which is disposed between the base body and the receiving body in such a manner that a further spring force of the further spring element acts in the direction of a first direction of rotation of the receiving body. The first direction of rotation here describes a rotation of the receiving body from the open position into the closed position.

It is thereby ensured that without the person to be secured intentionally exerting a force on the receiving body, this is urged into the closed position as a result of the further spring force. For turning the receiving element from the closed position into the open position, a force must therefore be exerted which is contrary to the spring force and which is greater than the further spring force in order to turn the receiving body into the open position.

According to a further exemplary embodiment, the securing device comprises a securing flap which is disposed rotatably on the base body in such a manner that a centre of gravity of the securing flap is spaced apart from a third axis of rotation of the securing flap about the base body so that a gravity-based rotation of the securing flap can be provided based on the alignment of the base body. The securing flap is disposed rotatably on the base body in such a manner that in an incorrect position of the base body relative to the securing means the securing flap is rotatable in a gravity-based manner into a locking position in which an insertion of the securing means between the receiving body and the guide element or into the groove is blocked.

With the securing flap a safety mechanism is provided which prevents the person to be secured from fastening the securing device, for example, the wrong way round with respect to the securing means. If the securing device is for example aligned the wrong way round with respect to the securing means, the securing flap turns in the direction of the receiving body as a result of gravity so that the insertion of the securing element between the receiving body and the guide element e.g. into the groove is prevented.

This increases the operating safety of the securing device since, for example if the securing device is incorrectly positioned with respect to the securing element, the securing functions (e.g. function of the brake lever or the securing element) of the securing device can be disturbed.

It is pointed out that the embodiments described here merely constitute a limited selection of possible embodiments of the invention. Thus, it is possible to combine the features of individual embodiments in a suitable manner with one another so that for the person skilled in the art, with the explicit embodiments here, a plurality of different embodiments are to be considered to be obviously disclosed.

BRIEF DESCRIPTION OF THE DRAWINGS

In the following for further explanation and for better understanding of the present invention exemplary embodiments are described in detail by reference to the appended figures. In the figures.

DETAILED DESCRIPTION OF EXEMPLARY EMBODIMENTS

The same or similar components are provided with the same reference numbers in the figures. The diagrams in the figures are schematic and not to scale.

Figure 1:
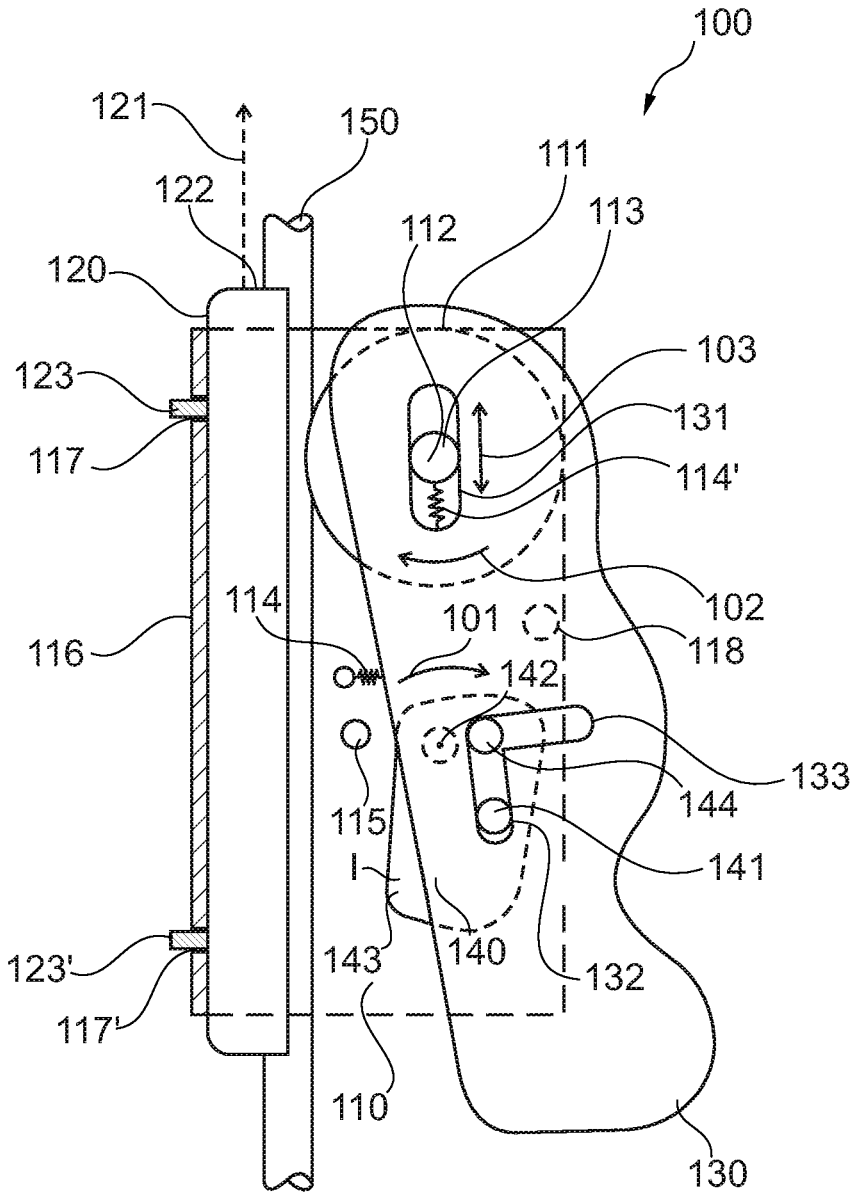
FIG. 1 shows a schematic diagram of the securing device with a guide roller as a guide element and a securing element in the free-running position according to an exemplary embodiment of the invention.
Figure 2:
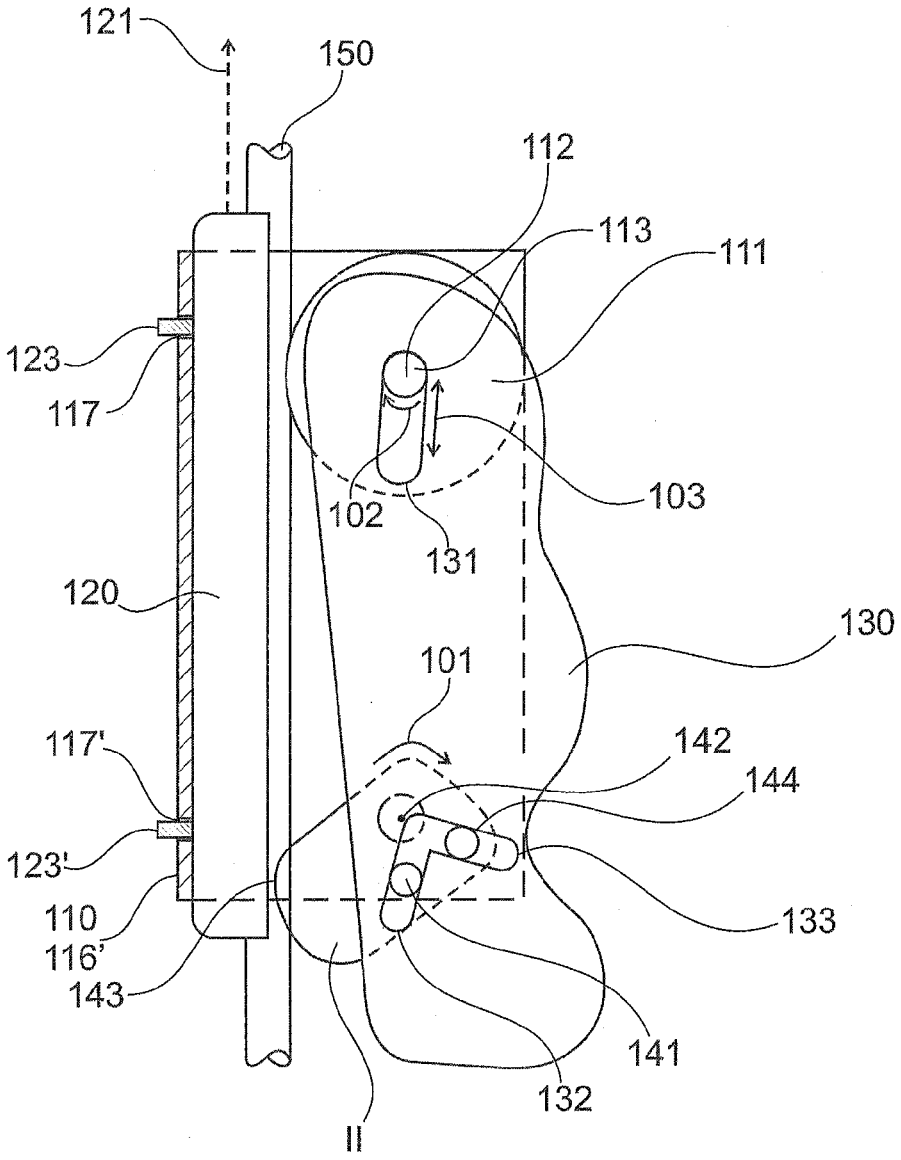
FIG. 2 shows a schematic diagram of the exemplary embodiment from FIG. 1 in which the securing element is pivoted into the clamping position according to an exemplary embodiment of the present invention.

FIG. 1 and FIG. 2 show a cable securing device 100 which is adapted for running along an elongate securing means 150 on a person to be secured such as, for example, a retaining cable as shown in FIG. 1.

A guide element 111, such as for example a rotatably mounted cable guide roller is disposed on a base body 110. Furthermore, a receiving body 120 is disposed on the base body 110. The receiving body 120 has a longitudinal axis 121. The receiving body 120 further has a groove 122. The groove 122 in particular has a longitudinal extension where the longitudinal extension runs parallel to the longitudinal axis 121 of the receiving body 120. The receiving body 120 can, as shown in FIG. 1 and FIG. 2, for example, have a cylindrical shape where the longitudinal axis 121 for example forms the axis of symmetry of the cylindrical receiving body 120.

The receiving body 120 can, as shown in FIG. 1 and FIG. 2 be fastened rotatably by a coupling element 116 on the base body 110, in particular rotatably about the longitudinal axis 121.

The coupling element 116 can in this case form an open profile in cross-section and surround the receiving body 120 at least partially. The receiving body 120 can, for example have two coupling bolts 123, 123' which are coupled in corresponding coupling grooves 117, 117' of the coupling element 116.

In an operating state of the securing device 100, as shown in FIG. 1 and FIG. 2, the securing means 150 is guided in the groove 122 of the receiving body 120. The securing means 150 is guided between the guide element 111 and the receiving body 120.

Furthermore the securing device 100 has a securing element 140 with a first securing bolt 141. The securing element 140 is fastened rotatably about a first axis of rotation 142 on the base body 110, for example, by a pivot pin.

Furthermore, a housing 130 is fastened rotatably and/or displaceably on the base body 110. The housing 130 can, for example, surround the base body 110 and the securing element 140 at least partially.

The housing 130 is further coupled to the securing bolt 141 in such a manner that during a movement of the housing 130 relative to the base body 110 the securing element 140 is rotatable about the first axis of rotation 142 so that as a result of a first rotation 101 one end 143 of the securing element 140 is movable in the direction of the groove 122 so that the securing means 150 can be clamped between the receiving body 120 and the securing element 140.

FIG. 1 shows the securing element 140 in the free-running position I in which the securing means 150 is not clamped between the securing element 140 and the receiving body 120.

FIG. 2 shows for example the securing element 140 in clamping position II where in clamping position II the securing means 150 is clamped between the receiving body 120 and the securing element 140.

Figure 3:
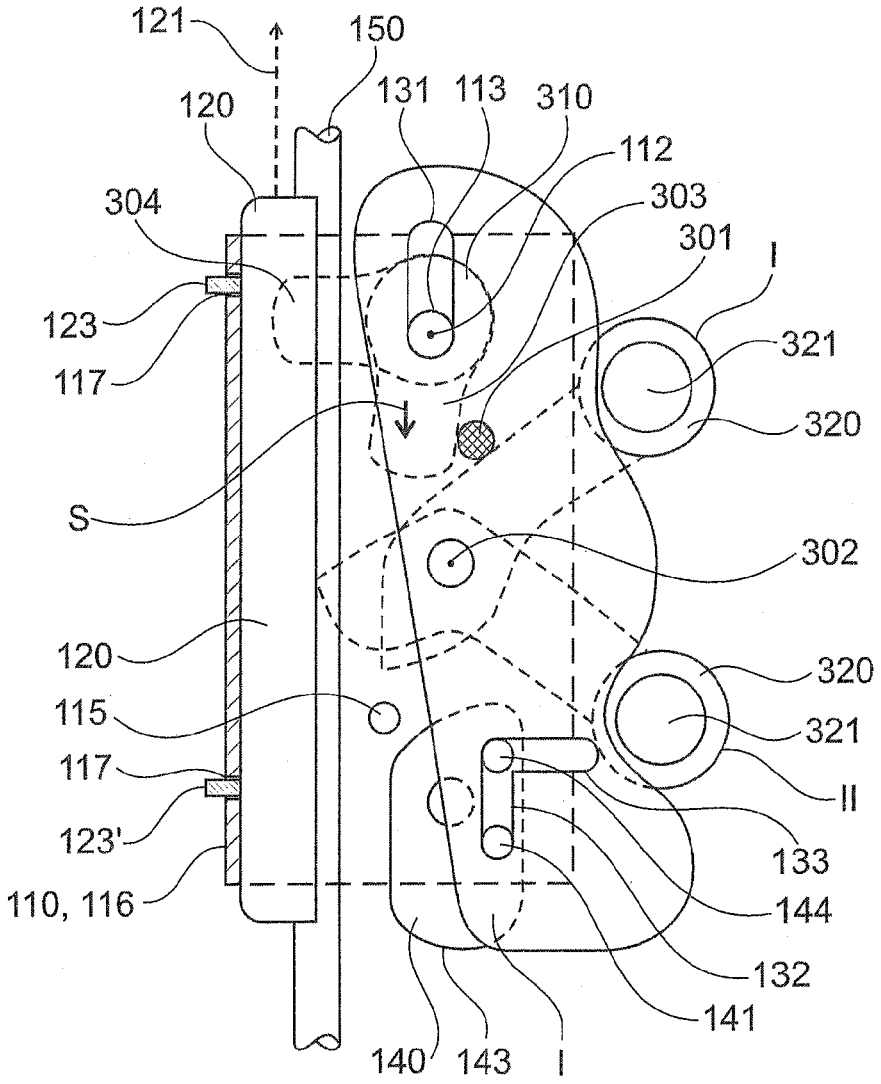
FIG. 3 shows a schematic diagram of a securing device with a securing element, a brake lever and a securing flap according to an exemplary embodiment of the present invention.

It should further be noted that for better clarity in FIG. 1 to FIG. 3 only the boundary lines of the housing 130 are shown in order to show the interior functional elements of the securing device 100 more clearly.

The housing 130 can be fastened rotatably about a second axis of rotation 112 on the base body 110, for example, by a pivot pin 113 which is fastened on the base body 110. The first securing bolt 141 of the securing element 140 is in this case coupled to the housing 130 in such a manner that during a second rotation 102 of the housing 130 about the second axis of rotation 112 relative to the base body 110, the rotation 101 of the securing element 140 about the first axis of rotation 142 can be produced.

A person to be secured can be coupled, for example, by the fastening region 118 (e.g. an eye) of the base body 110 to the securing device 100.

A braking action or a clamping between the securing device 100 and the securing means 150 can be achieved, for example, manually by the securing element 140 whereby the person to be secured turns the housing 130, for example, about the second axis of rotation. This can be accomplished, for example by the person to be secured enclosing the housing 130 and the coupling element 116 with his hand and pressing together both elements (coupling element 116 and housing 130). As a result of the rotation of the housing 130 about the second axis of rotation 112, the first securing bolt 141 is moved along a tangential direction relative to the second axis of rotation 112. As a result of the movement of the securing bolt 141 along the tangential direction relative to the second axis of rotation 112, the first rotation 101 of the securing element 140 about the first axis of rotation 142 is produced. In other words, the securing element 140 thus rotates in the direction of the securing groove 122 of the receiving body 120.

As shown in FIG. 2, the securing element 140 rotates into clamping position II so that the friction between the securing means 150 and the first end 143 of the securing element on the one hand and the groove 120 or the receiving body 120 on the other hand is increased and a braking action is produced between the securing means 150 and the securing device 100 or a complete clamping is achieved between the securing means 150 and the securing device 100.

In particular FIG. 1 shows that the first securing bolt 141 for example is coupled in a second guide groove 132 of the housing 130. The second guide groove 132 is configured in such a manner that the first securing bolt 141 transfers a force along a tangential direction relative to the first axis of rotation 142 onto the securing element 140 and thus produces the first rotation 101. At the same time, during the rotational movement of the housing 130 and the securing element 140, the first securing bolt 141 can be displaced along the second guide groove 132 in order to achieve a smooth movement sequence between the housing 130 and the securing element 140.

Furthermore FIG. 1 and FIG. 2 show the housing 130 which for example has a first guide groove 131. The pivot pin 113 is coupled to the first guide groove 131 in such a manner that the housing 130 is fastened translationally displaceably relative to the base body 110. In other words, in addition to the rotational movement about the second axis of rotation 112, the housing 130 can additionally or alternatively be displaced along a translational movement 103 relative to the base body 110.

The possibility of the displacement 103 of the housing 130 relative to the base body 110 has the effect that the person to be secured can, for example, when viewed from above in FIG. 1 and FIG. 2 press on the housing 130 in order to bring about a displacement of the housing 130 downwards, in particular along the longitudinal axis 121. This displacement 103 of the housing 130 has the result that the housing 130 transmits a force having a tangential component relative to the first axis of rotation 142 onto the first pivot pin 141 and/or the second pivot pin 144 so that the securing element 140 rotates into the clamping position II (see FIG. 2) and thus a braking action is brought about between securing device 100 and securing means 150.

In order to effect a smooth movement sequence between the housing 130 and the securing element 140 in particular when exerting the displacement 103 of the housing 130, a further second guide groove 133 can be formed in the housing 130. Furthermore, the securing element 140 can comprise the second securing bolt 144. As shown in FIGS. 1 and 2, the second guide groove 133 does not run parallel to the second guide groove 132 but runs at an angle to the second guide groove 132. In particular an angle can be formed between the second guide groove 132 and the further second guide groove 133 of about 85° to 95° (degrees).

During a displacement 103 of the housing 130 relative to the base body 110, a force is exerted in the direction of the displacement 103 and in particular a tangential component of the force relative to the first axis of rotations 142 on the second securing bolt 144. The securing bolt 144 is configured to be at a distance from the first axis of rotation 142. The displacement 103 of the housing 130 transmits a tangential component of the force relative to the first axis of rotation 142. As a result during displacement 103 of the housing 130 the securing element 140 rotates from the free-running position I (FIG. 1) into the clamping position II (see FIG. 2).

In the exemplary embodiment as shown in FIG. 1 to FIG. 3, the person to be secured can on the one hand press the housing 130 in the direction of the securing means 150 (second rotation 102) or press the housing 130 along the securing means 150 in particular along the longitudinal axis 121 (translational displacement 103). During both movements of the housing 130, on the one hand during rotation 102 in the direction of the securing means 150 and on the other hand during displacement 103 approximately parallel to the longitudinal axis 121, a rotation of the securing element 140 is produced so that a braking action or a clamping of the securing means 150 and the securing device 100 can be controlled manually by the person to be secured. As a result, an ergonomically easy to operate and quick to operate securing device 100 is provided in which the person to be secured can achieve a desired braking action at any time.

Furthermore a stop 115 can be disposed at a suitable point of the base body 110 in order to specifically limit the rotation of the securing element 140 or the rotation of the housing 130.

Furthermore spring elements 114, 114' can be provided which couple the base body 110 and the housing 130. The spring elements 114, 114' in this case produce a spring force which is directed in such a manner that an initial position of the base body 110 relative to the housing 130 is set when the person to be secured exerts no force on the housing 130. In the initial position a movement of the securing means 150 in the groove 122 is possible.

FIG. 3 shows a further exemplary embodiment of the securing device 100. The embodiment of the securing device 100 has the same features as the securing device 100 from FIG. 1 and FIG. 2. The securing element 140 is shown in the free-running position I in FIG. 3.

In addition, the securing device 100 in FIG. 3 has a securing flap 310 and a brake lever 320. Furthermore FIG. 3 shows the brake lever 320 in free-running position I and in clamping position II and the securing flap 310 in insertion position 303 and in locking position 304. The brake lever is fastened rotatably, for example, by a further pivot pin 302 on the base body 110. A coupling region such as, for example, a fastening eye 321 for coupling on the person to be secured is formed at a first end of the brake lever 320 and a clamping region is formed at a second end of the brake lever 320 which is formed opposite the first end with respect to the axis of rotation of the brake lever 120 with respect to the base body 110. The brake lever 320 is disposed rotatably on the base body 110 in such a manner that the clamping region of the brake lever 320 is movable in the direction of the groove 122 so that a clamping of the securing means 150 can be produced between the receiving body 120 and the brake lever 320.

A retaining cable can be fastened, for example at the coupling region, which is fastened to a harness of the person to be secured. If the person to be secured ascends, for example, along a first direction (upwards viewed in FIG. 3), as a result of the coupling to the brake lever 320 the person to be secured also pulls the securing device 100 upwards. At the same time the brake lever 320 is pivoted into free-running position I.

In the event of a fall of the person to be secured along a second direction (downwards viewed in FIG. 3) along the securing means 150, the brake lever 320 is pivoted downwards into clamping position II. A clamping thus occurs between the brake lever 320 and the securing means 150 so that a relative displacement between the securing means 150 and the securing device 100 is prevented. The clamping position II of the brake lever 320 is therefore automatically set if the person to be secured falls, without this person needing to manually actuate the brake lever 320. The clamping between the brake lever 320 and the securing means 150 can, for example, begin with a horizontal alignment of the brake lever (in particular with a horizontal alignment of the lever region which connects the pivot point of the brake lever 320 to the coupling region 321). Even a slight clamping of the clamping of the clamping region of the brake lever 320 with the securing means 150 leads to an increase in the friction and to an entrainment effect of the brake lever so that the brake lever 320 is automatically transferred into the clamping position II during a relative movement to the securing means 150.

FIG. 3 further shows the securing flap 310 in insertion position 303 and in locking position 304. The securing flap 310 is disposed rotatably on the base body 110 so that a centre of gravity S of the securing flap 310 is formed at a distance from a third axis of rotation of the securing flap 310 and the base body 110. The third axis of rotation can, for example, be identical to the second axis of rotation 112. In other words the securing flap 310 together with the guide element 111 (not shown in FIG. 3 for better clarity) can be rotatably fastened on the pivot pin 113.

Since the centre of gravity S of the securing flap 310 is at a distance from the third axis of rotation, a gravity-based rotation of the securing flap 310 based on the alignment of the base body 110 is possible. In FIG. 3 the alignment of the securing device 100 with respect to the securing means 150 is shown correctly. As a result of the arrangement of the centre of gravity S of the securing flap 310, the securing flap 310 pivots into the insertion position 303. In insertion position 303, provided that the receiving body 120 is rotated into open position, for example, the securing means 150 can be inserted into the groove 122 or withdrawn therefrom.

Assuming that the securing device 100 is twisted with respect to the alignment shown in FIG. 3 relative to the securing means 150 by 180° in the plane of the drawing, the arrangement of the centre of gravity S of the securing flap 310 has the result that the securing flap 310 pivots into the locking position 304. In the locking position 304 the securing flap 310 blocks an insertion or a withdrawal of the securing means 150 from the groove 122 regardless of whether the receiving body 120 is rotated into the open position or closed position. This increases the operating safety of the securing device 100 since in an incorrect position of the base body 110 relative to the securing means 150, the securing flap 310 is rotatable based on gravity into the locking position 304 in which an insertion of the securing means 150 into the groove 122 is blocked.

Furthermore a further stop 301 can be provided on the base body which prevents an overrotation or an undesired displacement of the brake lever 320 or the securing flap 310.

Figure 4:
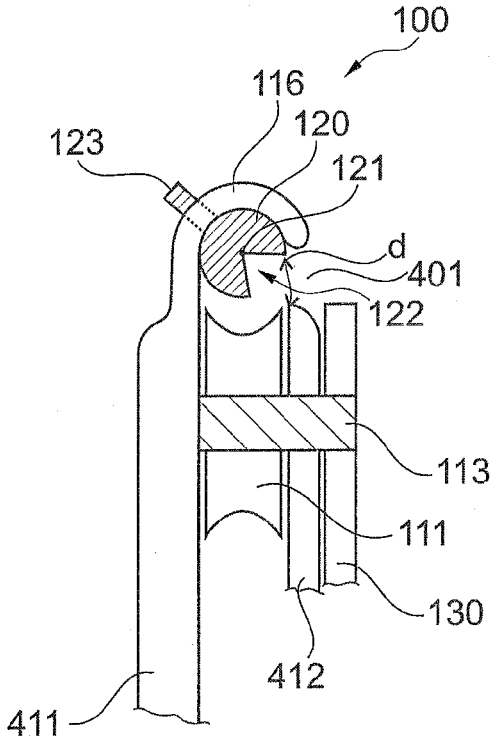
FIG. 4 shows a schematic diagram of a securing device in which the receiving body is shown in the open position according to an exemplary embodiment of the present invention.
Figure 5:
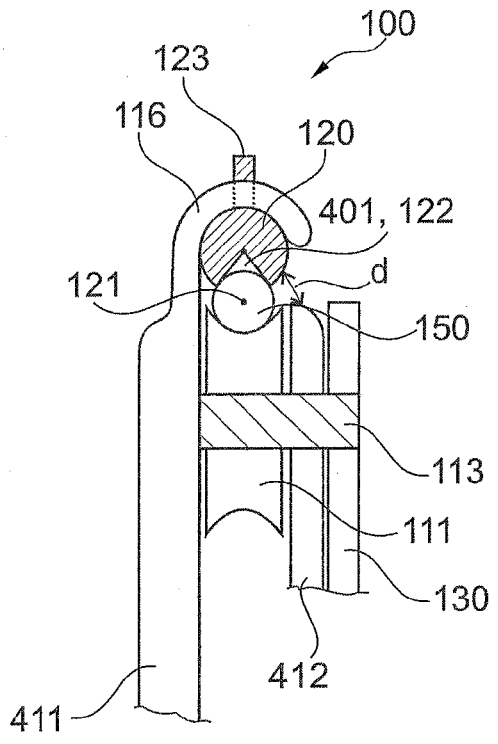
FIG. 5 shows a schematic diagram of a securing device in which the receiving body is shown in the closed position according to an exemplary embodiment of the present invention.

FIG. 4 and FIG. 5 show schematically a plan view of the securing device 100.

The coupling element 116 has an open profile in cross-section and at least partially surrounds the receiving body 120. The receiving body 120 is rotatable about the longitudinal axis 121 as the axis of rotation relative to the coupling element 116. The receiving body 120 for example has a coupling bolt 123 which is guided in a coupling groove 117 (not shown in FIGS. 4 and 5) of the coupling element 116.

Furthermore, in FIG. 4 and FIG. 5 the guide element 111 is configured as a guide roller. The guide element 111 and the housing 130 are, for example, rotatably fastened on the base body 110 by a common pivot pin 113.

In particular the base body 110 is configured with two plate-shaped base elements 411, 412. The first base element 411 and the second base element 412 are formed at a distance from one another and rigidly connected to one another by connecting elements (not shown) so that a cavity is formed between the first base element 411 and the second base element 412. The bolts or pivot pins 113 described can be fastened in the first base element 411 and the second base element 412 and run through the cavity. Thus, a more stable mounting of the bolt or pivot pin is provided since these are fastened to the base body 110 in each case at two fastening points. The housing 130 is, for example, fastened to the pivot pin 113 where the pivot pin 113 is fastened to the first base element 411 and the second base element 412.

The groove 122 is, for example, formed with a V-shaped profile shape 401 as shown in FIG. 4 and FIG. 5.

As shown in FIG. 5, the securing means 150 is inserted in the groove 122 so that the securing means 150 is guided between the receiving body 120 and the guide element 111. In other words, the securing device 100 can be displaced along the securing means 150.

FIG. 4 shows the receiving body 120 in the open position. The distance d between the receiving body 120 and the base body 110 is greater than the diameter or the thickness of the guide means 150 to be inserted. Thus, the guide means 150 can be inserted in the groove 122 and withdrawn therefrom.

FIG. 5 shows the receiving body 120 in the closed position. The securing means 150 is located between the receiving body 120 and the guide element 111. The distance d between the receiving body 120 and the base body 110 or in particular between the base element 412 and the receiving body 120 is smaller than the diameter or the thickness of the securing means 150 in the closed position of the receiving body 120. In other words, the smallest distance d between the receiving body 120 (or its surface) and the guide element 111, the base body 110 (or the second base element 412) and/or the housing 130 in this case is smaller than the diameter of the securing means 150 so that the securing means 150 cannot be withdrawn from the grasp of the receiving body 120 and the guide element 111.

Figure 6:
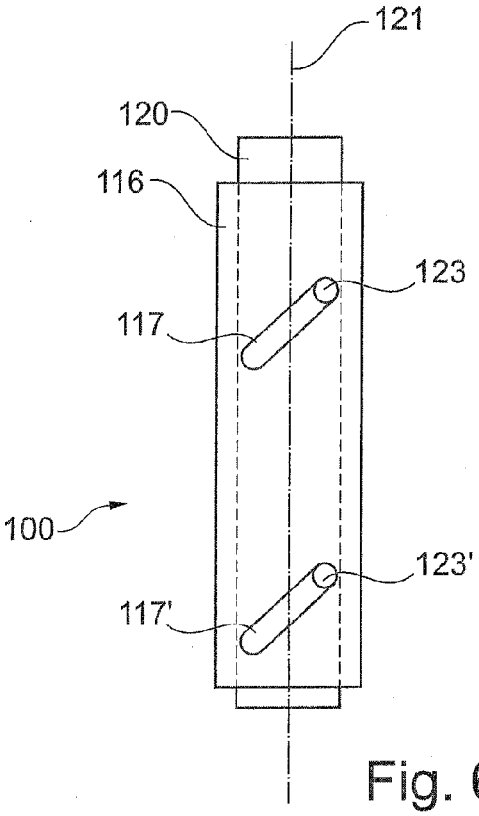
FIG. 6 and FIG. 7 show schematic diagrams of a securing device in which coupling grooves having a helical profile are shown in a coupling element according to an exemplary embodiment of the present invention.
Figure 7:
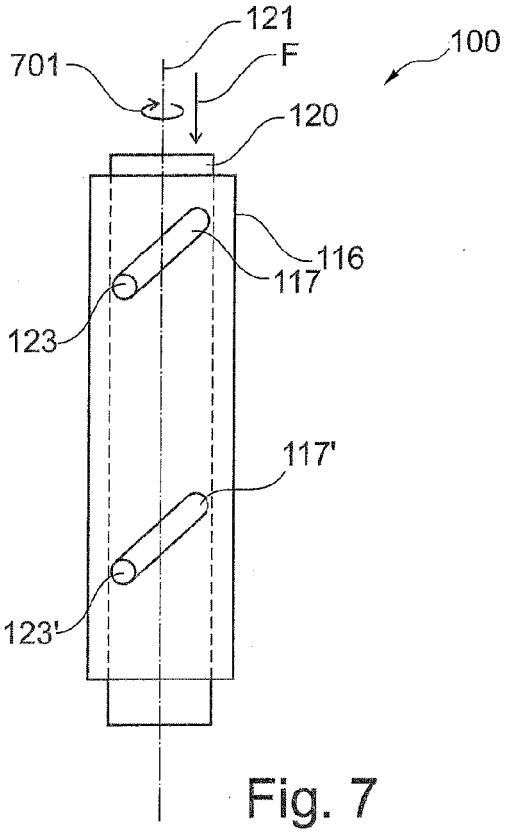

A further exemplary embodiment of the securing device 100 is shown in FIG. 6 and FIG. 7 where in particular the rotatable fastening of the receiving body 120 is shown with the coupling element 116. The receiving body 120 has a cylindrical shape where the longitudinal axis 121 of the receiving body 120 is provided as axis of rotation 121. The coupling element 116 at least partially encloses the receiving body 120. The receiving body 120 is coupled rotatably about the longitudinal axis 121 to the coupling element 116.

For this purpose, for example, the coupling element 116 has two coupling grooves 117, 117'. The receiving body 120 has two corresponding coupling bolts 123, 123' which are each coupled in the corresponding coupling grooves 117, 117'. The coupling grooves 117, 117' have a helical profile or the profile of a helical line about the longitudinal axis 121.

FIG. 6 shows the closed position of the receiving body 120 in which the securing means 150 is guided between the receiving body 120 and the guide element 111.

FIG. 7 shows the open position of the receiving body 120 in which the securing means 150 is inserted in the groove 122. Here, for example a force is exerted on the receiving body 120 by the person to be secured. As a result of the helical profiles of the respective coupling grooves 117, 117', in addition to the translational movement of the receiving body 120 parallel to the longitudinal axis 121, a rotational movement of the receiving body 120 about the longitudinal axis 121 is produced so that a rotational movement 701 of the receiving body 120 about the longitudinal axis 121 rotates the receiving body 120 from the closed position into the open position.

Furthermore, a further spring element can be provided between the coupling element 116 or the base body 110 and the receiving body 120, where the further spring element with its spring force forces the receiving body 120 against the rotation 701 of the receiving body 120 and/or acts against the force F along the longitudinal axis 121 in order to force the receiving body 120 into the closed position according to FIG. 6. The receiving body 120 is thus prevented from moving independently, i.e. without application of a force F, from the closed position into the open position.

Figure 8:
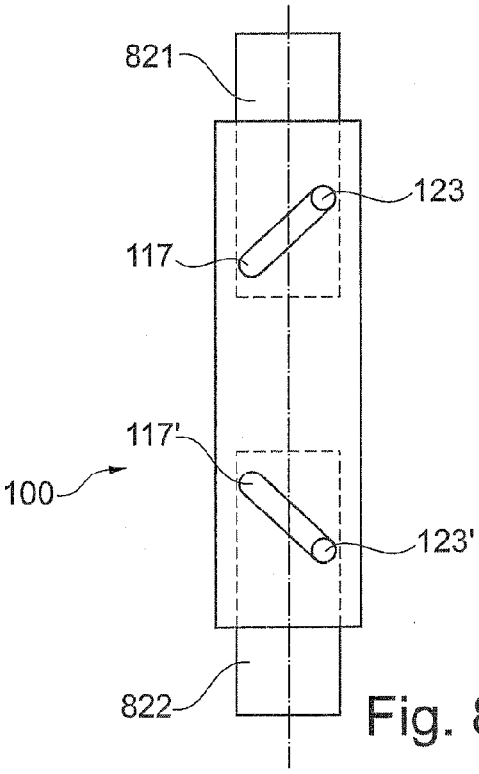
FIG. 8 and FIG. 9 show schematic diagrams of a securing device in which a first and a second receiving element of the base body are shown according to an exemplary embodiment of the present invention.
Figure 9:
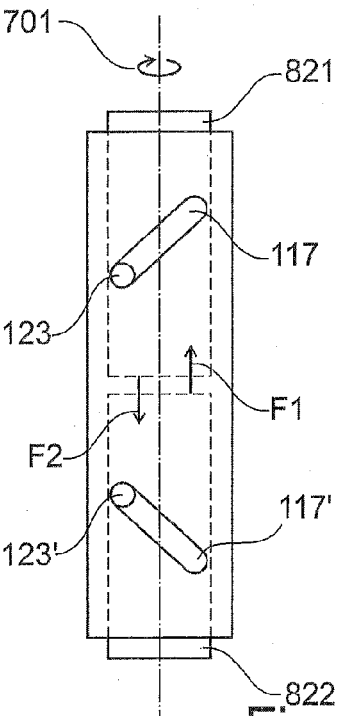

FIG. 8 and FIG. 9 show a further exemplary embodiment of the securing device 100 where in particular the rotatable fastening of the receiving body 120 with the coupling element 116 is shown. The receiving body 120 has a cylindrical shape where the longitudinal axis 121 of the receiving body 120 is provided as axis of rotation 121. The coupling element 116 at least partially encloses the receiving body 120. The receiving body 120 is coupled rotatably about the longitudinal axis 121 to the coupling element 116.

In particular the receiving body 120 comprises a first receiving element 821 and a second receiving element 822. The first and the second receiving element 821, 822 each comprise a first and a second part of the groove. Furthermore the receiving elements 821, 822 are rotatable independently of one another about the axis of rotation 821.

Furthermore, for example, the coupling element 116 has the two coupling grooves 117, 117'. The first receiving element 821 comprises the coupling bolt 123 and the second receiving element 822 comprises the coupling bolt 123'. The coupling bolts 117, 117' are each coupled in the corresponding coupling grooves 117, 117'. The coupling grooves 117, 117' have an opposed helical profile. In other words, the second coupling groove 117' (or its longitudinal extension) is disposed twisted by approximately 90° degrees with respect to the first coupling groove 117 (or its longitudinal extension) (see FIG. 8, FIG. 9).

FIG. 8 shows the closed position of the first receiving element 821 and the second receiving element 822 in which the securing means 150 is guided between the first receiving element 821 or the second receiving element 822 and the guide element 111 or one edge of the base body 110 or the second base element 412.

FIG. 9 shows the open position of the first receiving element 821 and the second receiving element 822 in which the securing means 150 can be inserted into the groove 122 of the first receiving element 821 and the second receiving element 822.

Here, for example, a first force F1 is applied to the first receiving element 821 and a second force F2, which is opposite to the first force F1, is applied to the second receiving element 822. As a result of the opposite helical profiles of the coupling grooves 117, 117', the receiving elements 821, 822 rotate about the same direction of rotation 701 about the longitudinal axis 121 despite different force directions of the forces F1, F2.

For turning the first receiving element 821 and the second receiving element 822 into the open position, the first receiving element 821 and the second receiving element 822 must be (simultaneously) compressed. As a result of the coupling grooves 117, 117', the receiving elements 821, 822 rotate into the open position when these are compressed.

It is thus prevented that in the event that one of the receiving elements 821, 822 is unintentionally rotated or pressed, the securing means 150 can be removed since the other non-twisted receiving element 821, 822 still remains in the closed position.

Furthermore the first spring element can be disposed between the first receiving element 821 and the second receiving element 822 where the further spring element with its spring force presses the first receiving element 821 and the second receiving element 822 apart in order to force the first receiving element 821 and the second receiving element 822 into the closed position. It is thus prevented that the first receiving element 821 and the second receiving element 822 are moved independently from the closed position into the open position, i.e. without application of a force F1 or F2.

Figure 10:
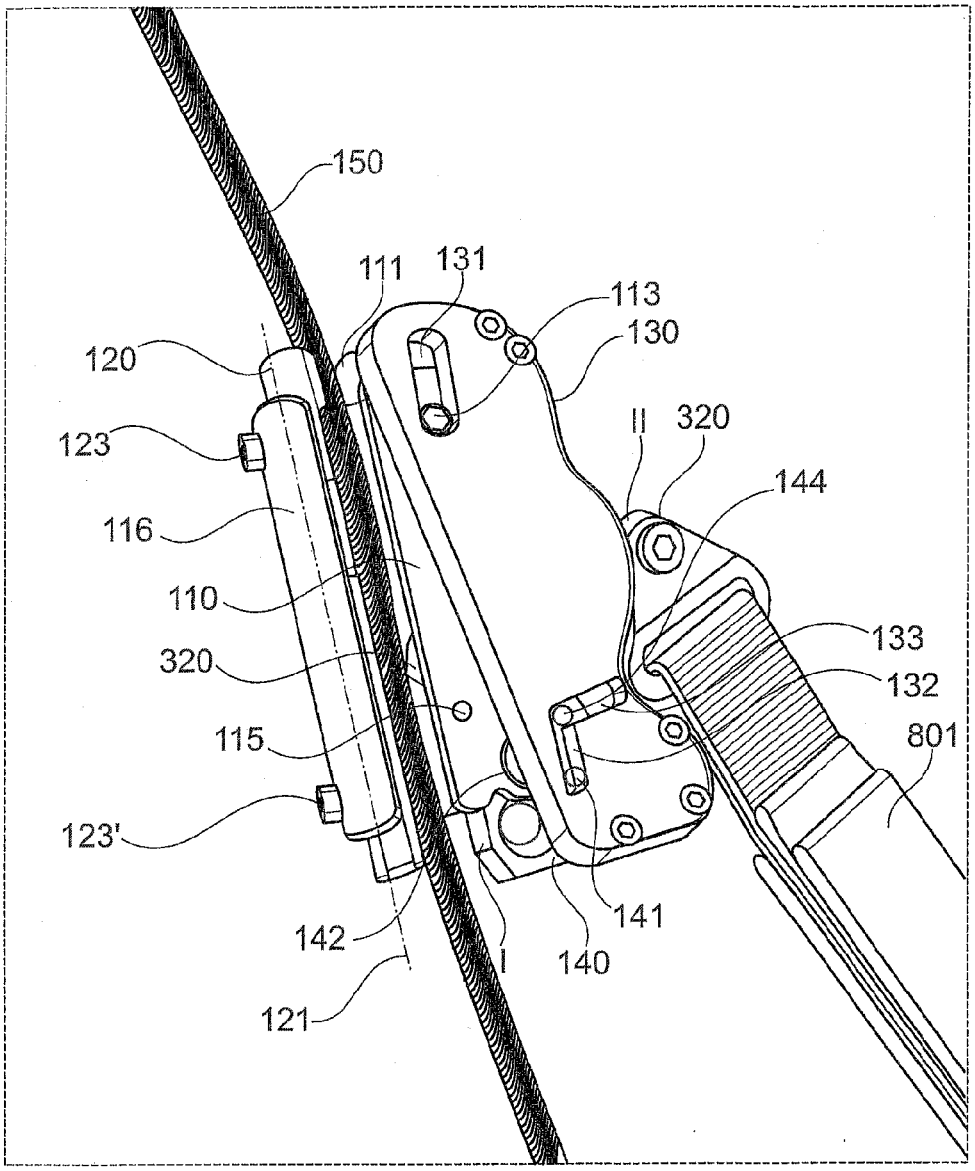
FIG. 10 shows a schematic diagram of the securing device which is fastened to a cable according to an exemplary embodiment of the present invention.

FIG. 10 shows an exemplary embodiment of the securing device 100 which is shown schematically in FIG. 1 to FIG. 9. In FIG. 10 the brake lever 320 is shown in clamping position II. A climber or the person to be secured is fastened, for example, by a climbing harness to the coupling region of the brake lever 320 by a retaining cable 801. The coupling region 321 of the brake lever 320 is pulled in the direction of the direction of gravity as a result of the weight of the person to be secured so that the clamping region of the brake lever 320 executes a rotary movement in the direction of the securing means 150 or the groove 122 in order to provide a clamping between the securing means 150 and the securing device 100.

Furthermore the pivot pin 113 is shown which on the one hand is coupled to the base body 110 and on the other hand is coupled to the housing 130 in the first guide groove 131. The housing 130 further comprises the second guide groove 132 and the further second guide groove 133 disposed at right angles to the second guide groove 132. The first securing bolt 141 is coupled in the second guide groove 132 and the second securing bolt 144 is coupled in the further second guide groove 133. The securing element 140 is shown in the free-running position I in FIG. 10. Furthermore FIG. 10 shows a fastening bolt which couples the securing element 140 to the base body 110 rotatably about the first axis of rotation 142. In addition, a stop 115 is shown in the base body 110, which specifically limits a rotational movement of the securing element 140.

The receiving body 120 is rotatably coupled via the coupling bolts 123, 123' in corresponding coupling grooves 117, 117' (not shown in FIG. 10) in the coupling element 116. The receiving body 120 is shown in the closed position in FIG. 10 so that the securing means 150 is guided between the guide element 111 and the receiving body 120 and cannot be removed from the securing device 100.

In addition, it should be pointed out that "comprising" does not exclude other elements or steps and "a" or "one" does not exclude a plurality. It should further be noted that features or steps which are described by reference to one of the above exemplary embodiments can also be used in combination with other features or steps or other exemplary embodiments described above. Reference numbers in the claims should not be seen as a restriction.

REFERENCE LIST

100 Securing device
101 First rotation of the securing element
102 Second rotation of the housing
103 Displacement of the housing relative to the base body
110 Base body
111 Guide element
112 Second axis of rotation
113 Pivot pin
114 Spring element
115 Stop
116 Coupling element
117 Coupling groove
118 Fastening region
120 Receiving body
121 Longitudinal axis
122 Groove
123 Coupling bolt
130 Housing
131 First guide groove
132 Second guide groove
133 Further second guide groove
140 Securing element
141 First securing bolt
142 First axis of rotation
143 End of securing element
144 Second securing bolt
150 Securing means
301 Further stop
302 Further pivot pin
303 Insertion position
304 Locking position
310 Securing flap
320 Brake lever
321 Fastening eye
401 V-shaped profile shape
411 First base element
412 Second base element
701 Rotation of the receiving body
821 First receiving element
822 Second receiving element
801 Retaining cable
I Free-running position
II Clamping position
F Force on receiving body
S Centre of gravity of securing flap
d Distance between receiving body and base body

The invention claimed is:

1. A securing device configured to be secured together with a person, and for running along an elongated cord being at least one of a cable, a belt, and a retaining rod, said securing device comprising:

a base body having a pivot pin;

a roller arranged about the pivot pin;

a receiving body, disposed on the base body such that the elongated cord is guidable between the receiving body and the roller;

a housing connected to the pivot pin with a biasing element, the housing having a first guide groove receiving the pivot pin such that the housing is configured to translate with respect to, and pivot about, said pivot pin; and a securing element having a first securing bolt and fastened rotatably about a first axis of rotation with respect to the base body, wherein the housing at least partially surrounds the base body and the securing element, the housing receives the first securing bolt in a second guide groove of the housing, the first securing bolt is configured to translate with respect to the second guide groove, and the housing is fastened to the base body about a second axis of rotation defined by the pivot pin;

wherein during a first rotation of the housing relative to the base body in a first direction, the securing element is rotatable about the first axis of rotation such that as a result of the first rotation, an end of the securing element is movable in the first direction toward the receiving body so that the elongated cord is configured to be clamped between the receiving body and the securing element.

2. The securing device according to claim 1, wherein the securing element is coupled to the housing such that during the first rotation of the housing about the second axis of rotation relative to the base body, a first rotation of the securing element about the first axis of rotation is creatable relative to the base body.

3. The securing device according to claim 1, wherein the pivot pin is coupled to the first guide groove such that the housing is fastened displaceably relative to the base body.

4. The securing device according to claim 3, wherein the first guide groove is configured such that during a displacement of the housing relative to the base body the first securing bolt is movable by the displacement of the housing such that the securing element is rotatable about the first axis of rotation.

5. The securing device according to claim 4, wherein the securing element has a second securing bolt, wherein the housing forms an extension of the second guide groove, which is configured at an angle to the second guide groove, wherein the extension of the second guide groove is configured such that the second securing bolt is received by the extension of the second guide groove such that during the displacement of the housing relative to the base body the securing element is rotatable about the first axis of rotation.

6. The securing device according to claim 1, further comprising:

a spring element, wherein, in an initial position of the base body relative to the housing, the securing element is configured for allowing a movement of the elongated cord along the receiving body, wherein the spring element is coupled to the base body and the housing such that by a spring force of the spring element the housing is aligned relative to the base body in the initial position.

7. The securing device according to claim 1, further comprising:

a brake lever which is fastened rotatably on the base body, wherein a coupling region for coupling on the person to be secured is formed at a first end of the brake lever and a clamping region is formed at a second end of the brake lever, which is formed opposite the first end, wherein the brake lever is configured for being disposed rotatably on the base body such that the clamping region is movable in a direction to the receiving body such that a clamping of the elongated cord is creatable between the receiving body and the brake lever.

8. The securing device according to claim 1, further comprising:

wherein the receiving body has a groove, wherein the receiving body is configured for being disposed on the base body such that the elongated cord is guidable in the groove between the receiving body and the roller.

9. The securing device according to claim 8, wherein the groove has a V-shaped cross-section.

10. The securing device according claim 1, wherein the roller has a further groove having a further V-shaped cross-section or having a U-shaped cross-section; and wherein the elongated cord is guidable in the further groove.

11. The securing device according to claim 1, wherein the receiving body has a fluted surface.

12. The securing device according to claim 1, wherein the receiving body is disposed rotatably about its longitudinal axis on the base body such that the receiving body is rotatable from a closed position into an open position; and wherein in the open position the elongated cord is insertable between the receiving body and the roller and in the closed position a withdrawal of the elongated cord between the receiving body and the roller is preventable.

13. The securing device according to claim 12, wherein the base body comprises a coupling element, wherein the coupling element couples the receiving body to the base body such that the receiving body is fastened rotatably between the open position and the closed position on the base body.

14. The securing device according to claim 13, wherein a coupling groove is formed in the coupling element, wherein the receiving body has a coupling bolt which is coupled in the coupling groove, wherein the coupling groove in the coupling element is formed such that the coupling bolt is guided along the coupling groove during rotation of the receiving body about the longitudinal axis.

15. The securing device according to claim 14, wherein the coupling groove further has a helical course about the longitudinal axis so that during application of a force on the receiving body along the longitudinal axis the receiving body is movable in the longitudinal direction and at the same time the receiving body is rotatable about the longitudinal axis.

16. The securing device according to claim 12, wherein a first direction of rotation describes a rotation of the receiving body from the open position into the closed position.

17. The securing device according to claim 1, further comprising:

a securing flap which is disposed rotatably on the base body such that a centre of gravity of the securing flap is spaced apart from a third axis of rotation of the securing flap about the base body so that a gravity-based rotation of the securing flap is providable based on an alignment of the base body, wherein the securing flap is disposed rotatably on the base body such that in an incorrect position of the base body relative to an elongated part the securing flap is rotatable into a locking position in which an insertion of the elongated cord between the receiving body and the roller is blocked.

18. A method for securing a person against falling, the method comprising the steps of:

providing a securing device, said securing device having a base body having a pivot pin;

a roller arranged about the pivot pin;

a receiving body, disposed on the base body such that the elongated cord is guidable between the receiving body and the roller;

a housing connected to the pivot pin with a biasing element, the housing having a first guide groove receiving the pivot pin such that the housing is configured to translate with respect to, and pivot about, said pivot pin; and a securing element having a first securing bolt and fastened rotatably about a first axis of rotation with respect to the base body, wherein the housing at least partially surrounds the base body and the securing element, the housing receives the first securing bolt in a second guide groove of the housing, the first securing bolt is configured to translate with respect to the second guide groove, and the housing is fastened to the base body about a second axis of rotation defined by the pivot pin;

wherein during a first rotation of the housing relative to the base body in a first direction, the securing element is rotatable about the first axis of rotation such that as a result of the first rotation: an end of the securing element is movable in the first direction toward the receiving body so that the elongated cord is configured to be clamped between the receiving body and the securing element;

attaching a safety lanyard to the securing device, wherein the safety lanyard is capable of attaching to a harness for a person;

inserting the elongate cord between the receiving body and the roller; and moving the securing device with respect to a major length of the elongate cord.

* * * * *